US009624713B2

(12) United States Patent
Campbell

(10) Patent No.: US 9,624,713 B2
(45) Date of Patent: Apr. 18, 2017

(54) CONNECTION SYSTEM FOR MEETING RAIL OF WINDOW

(71) Applicant: Ply Gem Industries, Inc., Cary, NC (US)

(72) Inventor: Colin David Campbell, Louisville, KY (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/141,961

(22) Filed: Dec. 27, 2013

(65) Prior Publication Data

US 2014/0186103 A1 Jul. 3, 2014

Related U.S. Application Data

(60) Provisional application No. 61/746,220, filed on Dec. 27, 2012, provisional application No. 61/865,798, filed on Aug. 14, 2013.

(51) Int. Cl.

| | |
|---|---|
| ***E06B 3/00*** | (2006.01) |
| ***E06B 3/06*** | (2006.01) |
| ***E06B 1/36*** | (2006.01) |
| ***E06B 1/52*** | (2006.01) |

(52) U.S. Cl.

CPC ..... *E06B 3/06* (2013.01); *E06B 1/366* (2013.01); *E06B 1/524* (2013.01); *Y10T 403/4949* (2015.01)

(58) Field of Classification Search

CPC ..... E06B 3/06

USPC ..... 52/204.58, 204.61, 656.1, 656.5, 656.6; 403/280

See application file for complete search history.

(56) References Cited

U.S. PATENT DOCUMENTS

| | | | | |
|---|---|---|---|---|
| 4,640,061 | A * | 2/1987 | Trumley | 52/71 |
| 5,461,837 | A * | 10/1995 | Chaney et al. | 52/204.68 |
| 2006/0196142 | A1* | 9/2006 | Liang | 52/712 |
| 2009/0205787 | A1* | 8/2009 | Allsopp | 160/84.01 |

* cited by examiner

*Primary Examiner* — Patrick Maestri

(74) *Attorney, Agent, or Firm* — Lathrop & Gage L.L.P.

(57) ABSTRACT

A connection system comprising an anchor connected to the window frame, a meeting rail having ends that may be snap fit to the anchor, and a single screw to tighten and true-up the connection once it is installed in the anchor. The connection system allows the meeting rail to be removed and replace from inside the building. In an alternative embodiment the disclosure details a kit for detachably securing a meeting rail to a frame jamb. The kit comprises separate anchors that are removably secured to the first and second side of the jamb frame and a profiled pin for insertion into the anchor for securing the meeting rail to the anchor and upon manual rotation of the pin the meeting rail and frame jambs are secured together.

17 Claims, 8 Drawing Sheets

CONNECTION SYSTEM FOR MEETING RAIL OF WINDOW

RELATED APPLICATIONS

This application claims the benefit of priority to U.S. Provisional Application Nos. 61/746,220 and 61/865,798 filed respectively on Dec. 27, 2012 and Aug. 14, 2013.

TECHNICAL FIELD

The present disclosure relates to devices for the easy connection and disconnection of a meeting rail of a window.

BACKGROUND

During the construction or remodeling of a building it is frequently necessary or desirable to remove the meeting rail of a window to allow building materials such as drywall, fixtures, and other objects to be moved into or out of the building through the window instead of through a door. This is especially true if the door is a long distance from the current or desired location of the objects being moved into or out of the building, or due to obstacles near the entrance that make it difficult to move large objects into or out of the structure. For the same reasons, it may also be desirable to move certain large objects such as furniture, appliances, and the like into an existing older structure through a window instead of a door.

Under normal conditions, a single hung window only allows access through the approximate bottom half by removing the sash. But by removing the meeting rail and top glass, the available space is approximately doubled. Meeting rails are frequently attached to the window frame or jamb via several screws or other attachment devices, and in order to remove the meeting rail to allow a large object to pass through the window, it is necessary to disassemble the meeting rail at both ends to remove it from the window frame and jamb and, of course, also necessary to reassemble the meeting rail once the moving operation has been completed.

Prior art exists of various mechanisms to accomplish this removal/reinstallation, but most designs have either too many fasteners to be customer-friendly, are not self-locating, or are not structurally sound enough for all weather conditions. It would be very useful to have a window meeting rail connection system that meets all these criteria.

SUMMARY

A connection system comprising an anchor connected to the window jamb, a meeting rail having ends that may be snap fit to the anchor, and a single screw or pin to tighten and true-up the connection once it is installed in the anchor. The connection system allows the meeting rail to be removed and replaced from inside the building.

DETAILED DESCRIPTION

The terms "top", "bottom", "upper", "lower", "upward", and "downward", as used in this detailed description, refer to the same directions on the properly oriented drawings. The term "front", as used in this detailed description refers to the side of a structure that is on or closest to the interior of a building or other structure. The term "back", as used in this detailed description refers to the side of a structure that is on or closest to the exterior of a building or other structure. It is understood, however, that the structure disclose herein may be oriented in any direction in actual use such as horizontally or vertically or even at an angle. These definitions, thus, only refer to this description in relation to the drawings.

Figure 1:
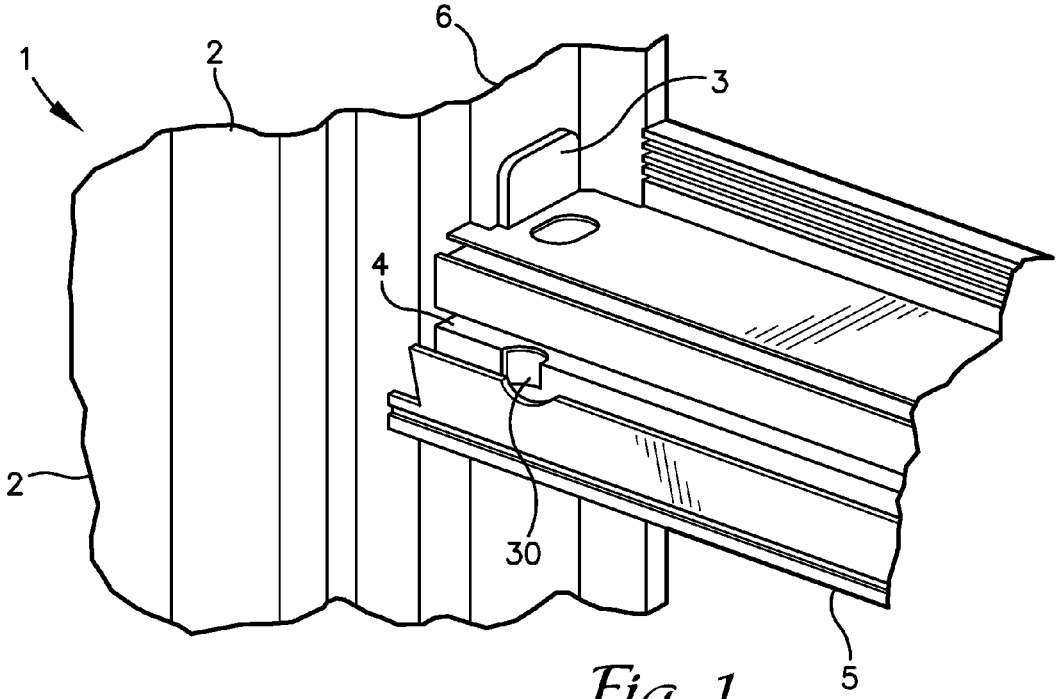
FIG. 1 is a perspective view of a meeting rail connector secured to a jamb of a window by an anchor.
Figure 2:
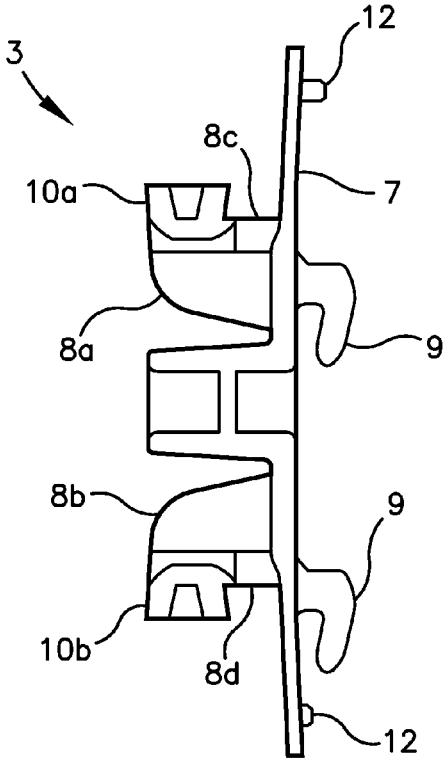
FIG. 2 is a side view of the anchor of FIG. 1.

As generally shown in FIGS. 1 and 2, a meeting rail connection system 1 of a window 2 comprises an anchor 3 and a rail connector 4. The connector 4 is incorporated in an end of a meeting rail 5. The anchor 3 is installed in a jamb 6 of the window 2. The meeting rail connection system 1 is located at the junction of the meeting rail 5 and the jamb 6 at each of the opposite sides of the window 2 and is operable from the interior of the structure in which the window 2 is installed.

Figure 3:
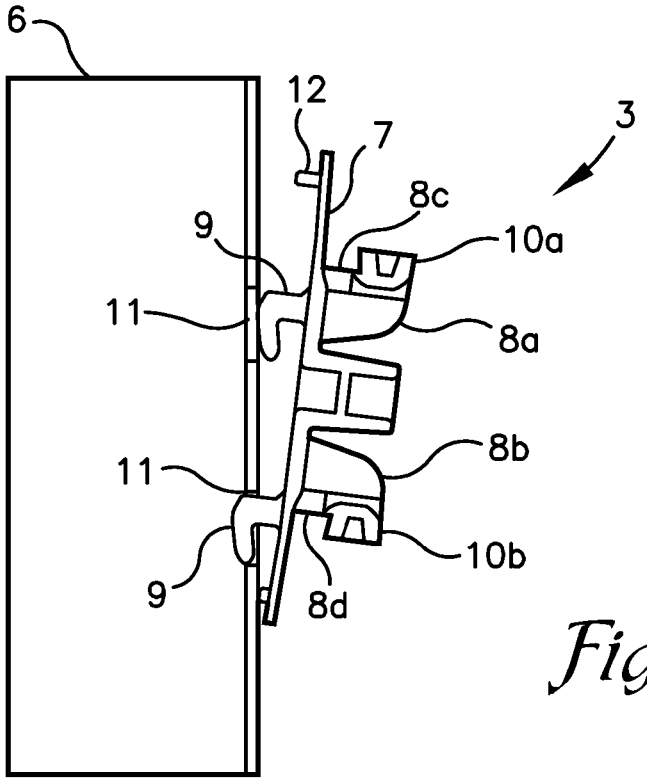
FIG. 3 is a side view of the anchor of FIG. 1 partially installed in the jamb of the window.
Figure 4:
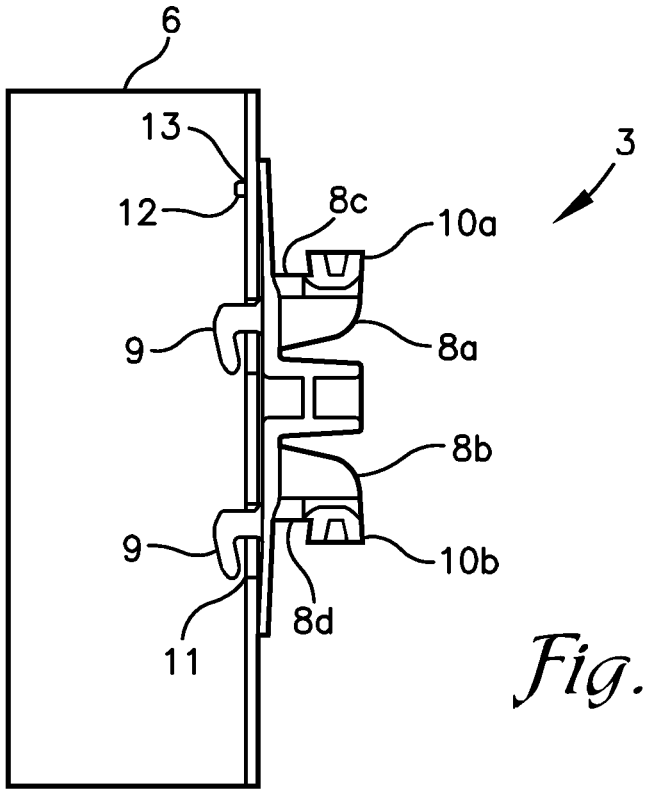
FIG. 4 is side view of the anchor of FIG. 1 installed in the jamb of the window.

As shown in FIGS. 2, 3 and 4, the anchor 3, which is preferably made of injection molded polycarbonate or some other flexible material, comprises a plate 7, an upper rail support 8*a*, a lower rail support 8*b*, and attachment hooks 9.

As shown in FIGS. 3 and 4, the upper rail support 8*a* has a top tab 10*a*, and the lower rail support 8*b* has a bottom tab 10*b*; the top and bottom tabs 10*a* and 10*b* are used to deform the respective rail supports 8*a* and 8*b* when the connector 4 of the meeting rail 5 is attached to the anchor 3. The upper rail support 8*a* has an upper surface 8*c*; the lower support rail 8*a* has a lower surface 8*d*.

As shown in FIGS. 3 and 4, the anchor 3 is connected to the jamb 6 by inserting the hooks 9 into slots 11 of the jamb 6. Projections 12 of the plate 7 are inserted into holes 13 in the jamb 6 and positively locate the anchor vertically once it is installed.

Figure 5:
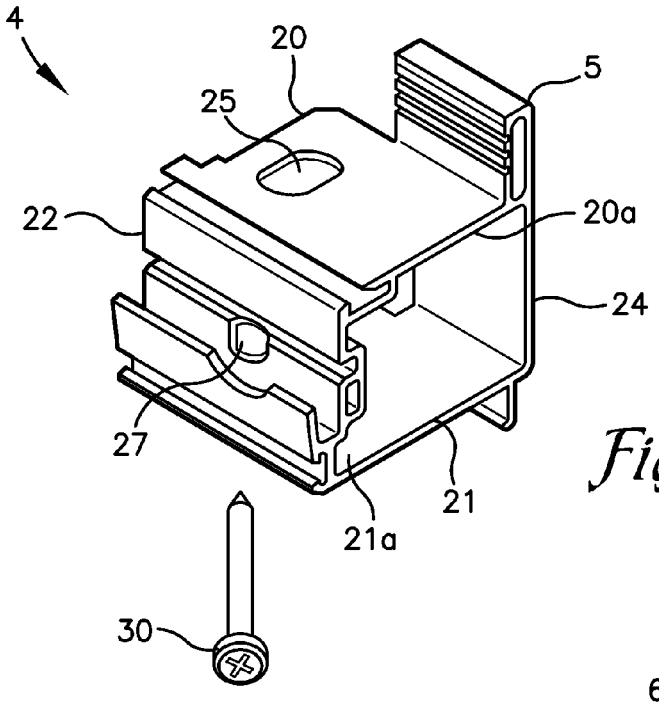
FIG. 5 is perspective view of the connector of FIG. 1.
Figure 6:
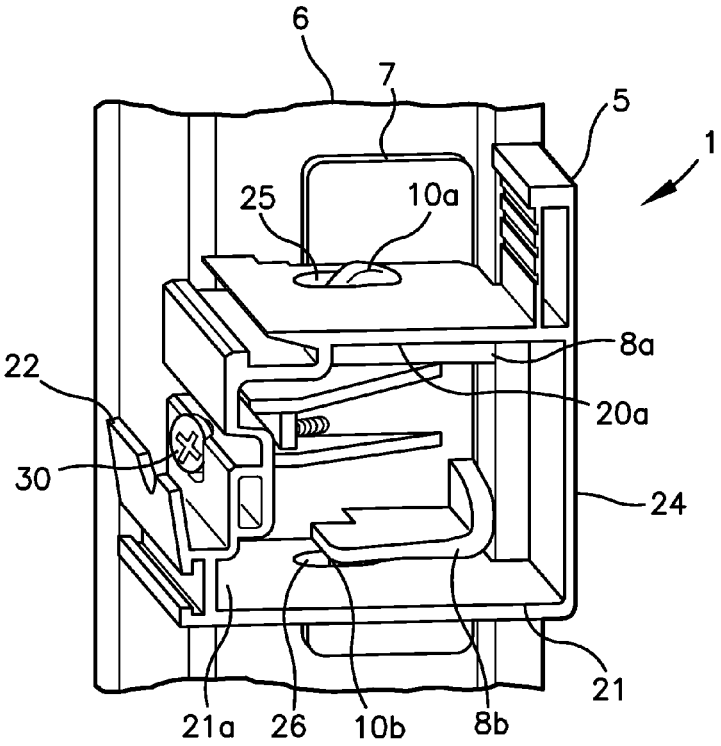
FIG. 6 is a perspective view of the connector of FIG. 5 installed on the anchor.

As shown in FIGS. 5 and 6, the rail connector 4 at the end of the meeting rail 5 comprises a top wall 20, a bottom wall 21, a front wall 22, and a back wall 24. The top wall 20 has a lower surface 20*a* and a hole 25 is disposed in the top wall 20. The bottom wall 21 has an upper surface 21*a* and a hole 26 is disposed within the bottom wall below and opposite the hole 25 of the top wall 20. The front wall 22 also includes a screw hole 27.

The distance between the lower surface 20*a* of the top wall 20 and the upper surface 21*a* of the bottom wall 21 of the connector 4 is approximately the same as the distance between the upper surface 8*c* of the upper rail support 8*a* and the lower surface 8*d* of the lower rail support 8*b*, creating a slip fit while still facilitating alignment of the connector 4. Alternately, the distance between the lower surface 20*a* of the top wall 20 and the upper surface 21*a* of the bottom wall 21 of the connector 4 can be less than the distance between the upper surface 8*c* of the upper rail support 8*a* and the lower surface 8*d* of the lower rail support 8*b*, creating a slight interference fit between connector 4 and the anchor 3. In either condition, when the upper tab 10*a* of the anchor 3 is pressed downward and the bottom tab 10*b* of the anchor 3 is press upward, for example, when the tabs 10*a* and 10*b* are pressed toward one another, the anchor 3 deforms so as to reduce the distance between the upper surface 8*c* of the upper rail support 8*a* and the lower surface 8*d* of the of the lower rail support 8*b*, allowing the upper and lower rail supports 8*a* and 8*b* of the anchor 3 to slide between top and bottom walls 20 and 21 of the connector 4.

The connector 4 is installed on the anchor 3 from the interior of the structure. The connector 4 slides onto the anchor 3 by sliding the connector 4 toward the exterior of the window while pressing the tabs 10 of the anchor toward each other, that is, the bottom tab 10*a* is pressed upward and the bottom tab 10*b* is pressed downward. The top wall 20 of the connector 4 slides over the top of the upper rail support 8*a*, and the bottom wall 21 of the connector 4 slides below the lower rail support 8*b*. The upper and lower rail supports 8*a* and 8*b* are being pressed or squeezed together while the connector 4 is being moved onto the anchor 3, and, when the connector 4 is in position on the anchor 3, the upper tab 10*a* is released and moves upward into hole 25 in the top wall 20, and the lower tab 10*b* moves downward into the hole 26 of in the bottom wall 21, locking the rail connector 4 onto the anchor 3.

In addition, when the upper tab 10*a* is released and moves up into hole 25, the upper surface 8*c* of the upper rail support 8*a* moves into contact with the lower surface 20*a* of the top wall 20 of the connector 4. Similarly, when the lower tab 10*b* is released and moved downward into hole 26, the lower rail support 8*b* moves into contact with the upper surface 21*a* of the bottom wall 21. When the walls 20 and 21 are so positioned, the meeting rail is positively located along with the anchor.

Once the connector 4 is installed on the anchor 3, a screw 30 may be inserted into the screw hole 27 and screwed into the window jamb 6 to tighten and/or true-up the connection. The screw 30 is installed at an oblique angle with respect to the connector 4 and the anchor 3, thus allowing the connector 4 and the anchor 3 to be simultaneously aligned along any arbitrary x, y, and z axes representing the height, width, and length of the connector 4 installed on the anchor 3.

In order to remove the connector 4 from the anchor 3, the screw 30 is removed from the screw hole 27, the tabs 10*a* and 10*b* are pressed downward and upward respectively so that the upper and lower tabs 10*a* and 10*b* are moved out of their respective holes 25 and 26 and the upper and lower rail supports 8*a* and 8*b* are moved out of contact with the respective upper and lower surfaces 20*a* and 21*a* of the top and bottom walls 20 and 21 of connector 4. When the tabs 10*a* and 10*b* are moved out of holes 25 and 26, the rail connector 4 may be moved toward the interior of the structure and out of the anchor 3. When this procedure is performed at both sides of the meeting rail 5, the meeting rail 5 may be removed from the window 2.

Figure 7:
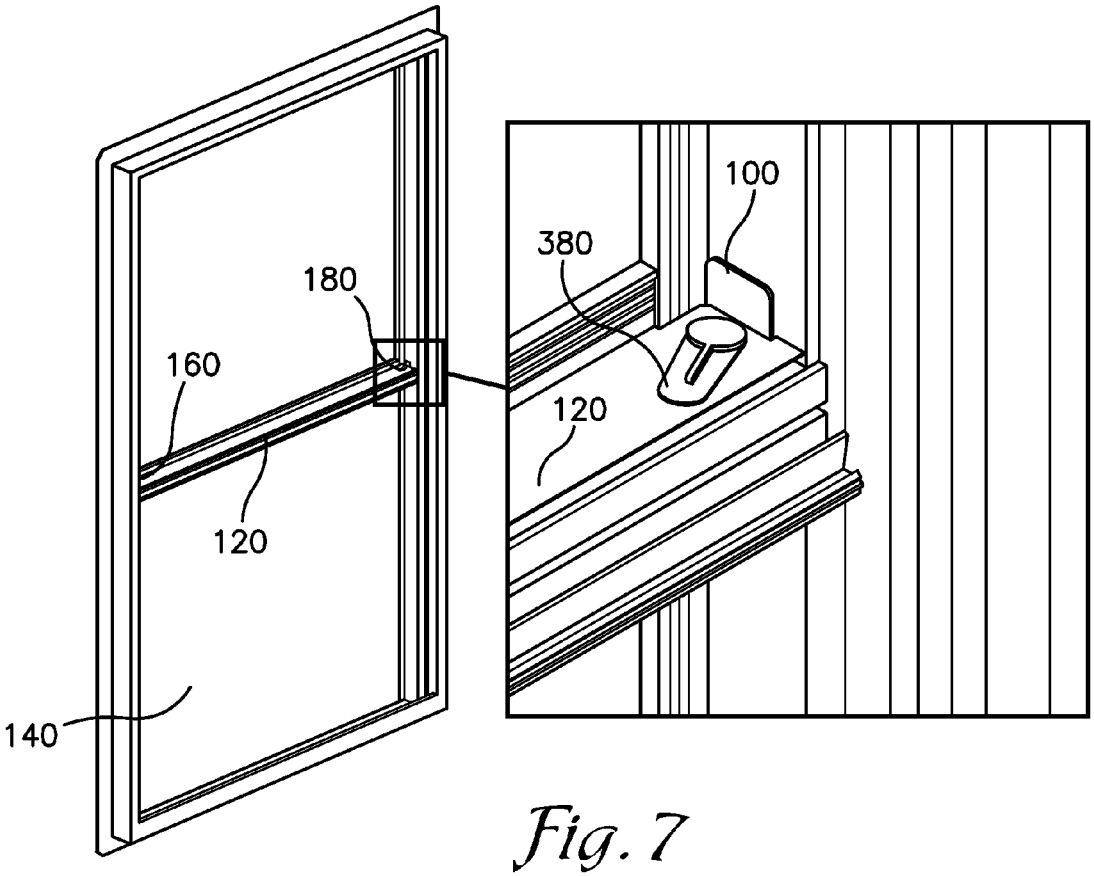
FIG. 7 is a perspective view of a single hung window with an adjacent enlarged image of the profiled pin inserted into the meeting rail and depicting the lever arm.

In an alternative embodiment of the connection system, FIG. 7 depicts a system 100 for quickly removing and reinstalling a meeting rail 120 in a single hung window 140. The two ends 160, 180 of the meeting rail 120 each engage an anchor 200 that mounts to the frame jambs 220, 240 on each side of the window sash.

Figure 8:
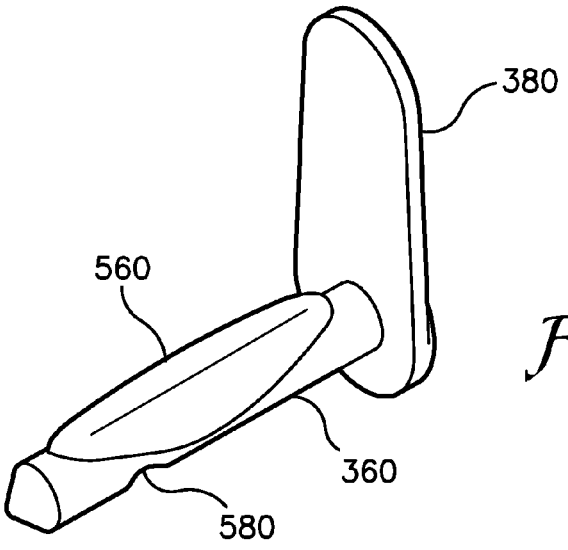
FIG. 8 is a perspective view of an embodiment of a profiled pin with lever arm.
Figure 9:
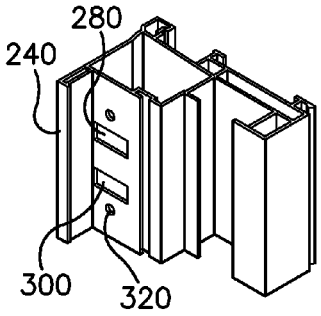
FIG. 9 is a perspective view of a cross section of a frame jamb of a window.
Figure 10:
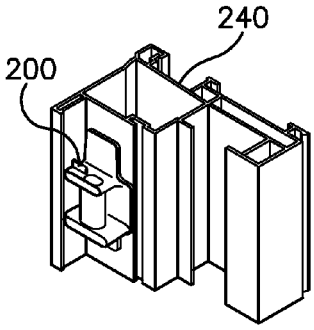
FIG. 10 is a perspective view of a cross section of a frame jamb of a window with an embodiment of the anchor fastened inserted into openings in the frame jamb.
Figure 11:
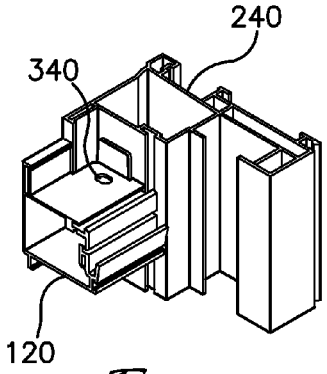
FIG. 11 is a perspective view of a cross section of a frame jamb of a window with a meeting rail inserted onto the anchor.
Figure 12:
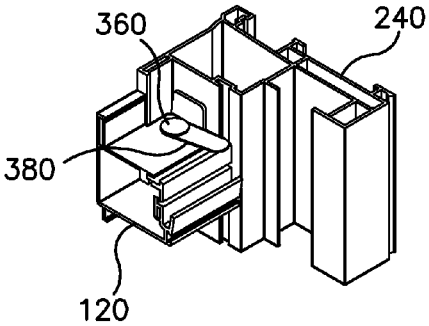
FIG. 12 is a perspective view of a cross section of a frame jamb of a window with the lever arm of a profiled pin shown atop the section of meeting rail.
Figure 13:
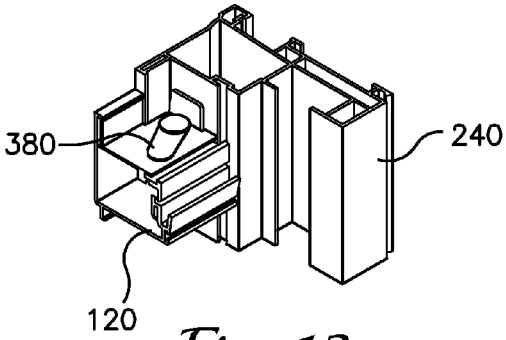
FIG. 13 is a perspective view of a cross section of a frame jamb of a window with the lever arm of a profiled pin shown atop the section of meeting rail and the profiled pin rotated to a locking position securing the meeting rail to the anchor and the frame jamb.

FIG. 9 provides a perspective view of the slots 280, 300 and locking holes 320 in the frame jamb 240 that are used to secure the anchor 200 in position. FIG. 10 depicts the anchor 200 in position on the frame jamb 240. FIG. 11 depicts the meeting rail 120 installed over the anchor 200 with a through hole 340 in the top of the mounting rail 120. FIG. 12 depicts the insertion of a profiled pin 360 (as best seen in perspective in FIG. 8) into the meeting rail 120 with the pin lever 380 in the unlocked orientation. FIG. 13 depicts the pin lever 380 rotated to the locking position securing the meeting rail 120 to the anchor 200 and ultimately to the frame jamb 240.

Figure 14:
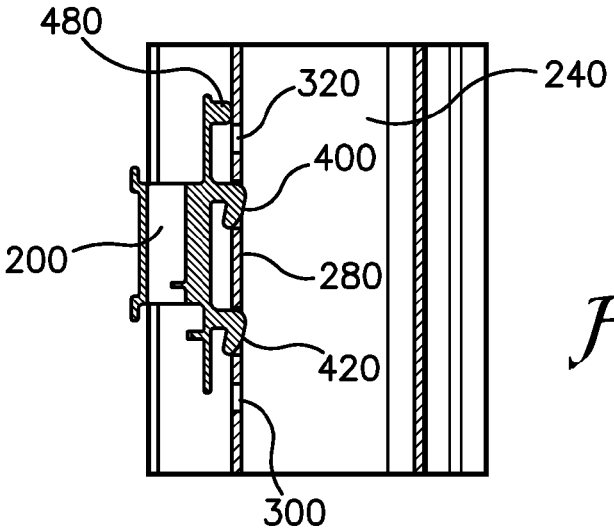
FIG. 14 is a side elevation view of an embodiment of the anchor disposed adjacent the frame jamb prior to insertion of the locking legs into openings in the frame jamb.
Figure 15:
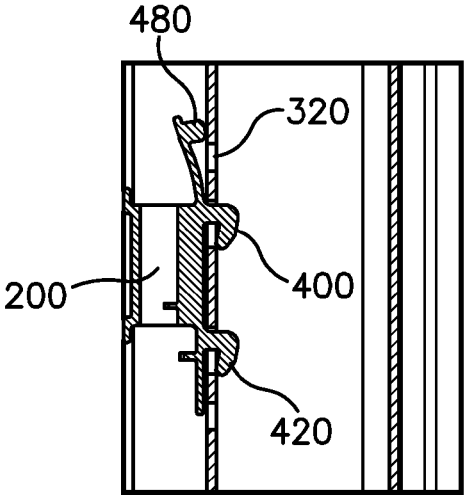
FIG. 15 is a side elevation view of an embodiment depicting two of the three anchor legs inserted into openings in the frame jamb.
Figure 16:
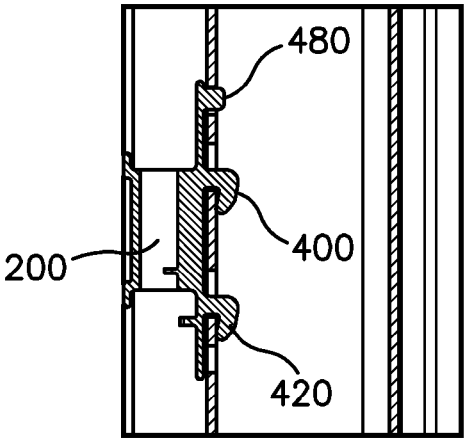
FIG. 16 is a side elevation view of an embodiment depicting all three of the anchor legs inserted into openings in the frame jamb.

FIG. 14 depicts a side elevation view of the anchor 200 prior to the insertion of the anchor legs 400, 420 into the slots 280, 300 in the frame jamb 240. FIG. 15 details the insertion of the anchor legs 400, 420 into the slots 280, 300; however, the locking plug 480 has not entered into the through hole 320 within the frame jamb 240. FIG. 16 details the insertion of the locking plug 480 into the through hole 320 of the frame jamb 240 thereby securing the anchor 200 in position on the frame jamb 240.

Figure 17:
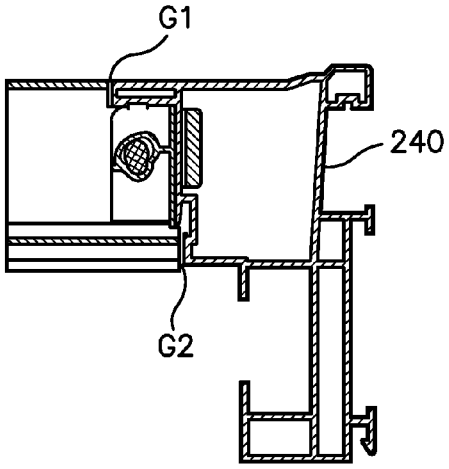
FIG. 17 is a plan view of a cross section of the frame jamb an embodiment of the anchor, meeting rail and profile pin prior to rotation of the profile pin to the locking position.
Figure 18:
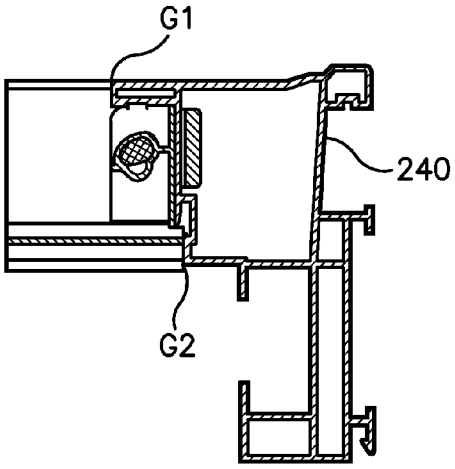
FIG. 18 is a plan view of a cross section of the frame jamb an embodiment of the anchor, meeting rail and profile pin in a locked position securing the meeting rail to the frame jamb.
Figure 19:
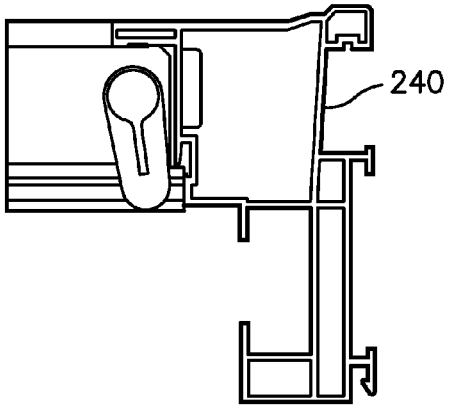
FIG. 19 is a plan view of a cross section of the frame jamb at the level of the meeting rail with the lever of the profile pin in the unlocked position.
Figure 20:
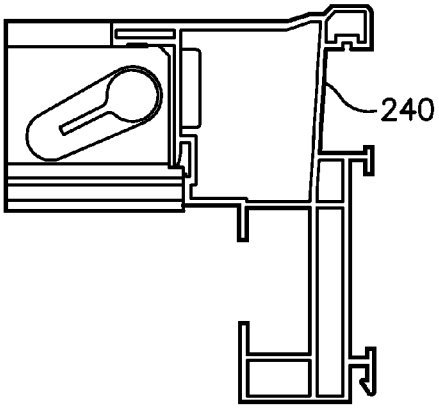
FIG. 20 is a plan view of a cross section of the frame jamb at the level of the meeting rail with the lever of the profile pin in the locked position.

FIG. 17 is a plan view cross section of the frame jamb 240 and the anchor 200 depicting the profile pin inserted into the anchor hole 340. In this orientation the meeting rail 120 is not fully engaged at the frame jamb 240 as shown by the gaps G1 and G2. The profile pin 360 is inserted into the hole 340 that passes through the meeting rail 120 and into the anchor 200. Once inserted, the pin lever 380 is rotated from the position shown in FIG. 19 to that shown in FIG. 20 thereby drawing the meeting rail 120 tight against the frame jamb 240 and preventing inadvertent displacement of the meeting rail from the frame jambs.

Figure 21:
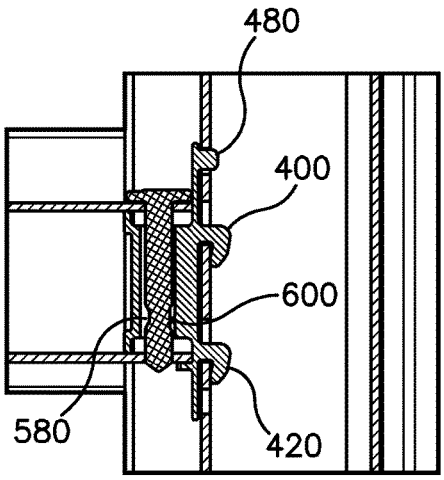
FIG. 21 is an elevation view of the meeting rail secured to an embodiment of the anchor which in turn is inserted into the frame jamb and the profile pin is inserted into the anchor in an unlocked orientation.
Figure 22:
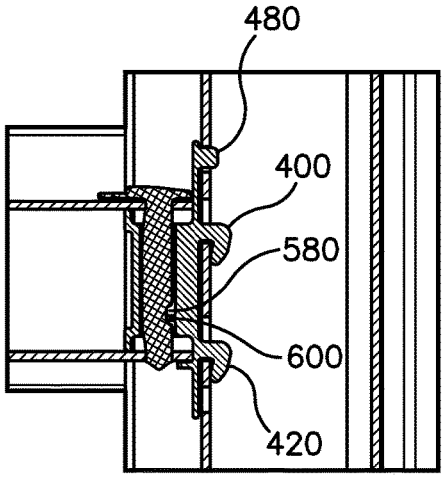
FIG. 22 is an elevation view of the meeting rail secured to an embodiment of the anchor which in turn is inserted into the frame jamb and the profile pin is inserted into the anchor in a locked orientation.

FIG. 21 depicts the orientation of the profiled pin when initially inserted through the opening 340 in the meeting rail 120 and in an unlocked orientation. The profiled pin 360 utilizes a cam lobe 560 (as best seen in FIG. 8) that when rotated there is a slight narrowing of the profile of the pin 360. FIG. 22; however, depicts the pin rotated to the locked orientation and the recess 580 (seen also in FIG. 8) is rotated around to the opposite side of the anchor 200 thereby allowing the recess 580 to engage a flange 600 thereby locking the pin vertically.

No additional hardware beyond the anchor 200 and the profiled pin 360 are required to install and remove the meeting rail from the frame jambs 220, 240.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

I claim:

1. A connection system for removably securing a window meeting rail to a window frame comprising:

(a) an anchor secured to an inside wall of a window jamb, the anchor having a plate with upper and lower rail supports adjacent the plate and projecting directly therefrom, the rail supports having respective vertically facing upper and lower surfaces and respective top and bottom tabs adjacent the respective upper and lower surfaces wherein the top and bottom tabs extend outwardly from the respective rail supports beyond the respective upper and lower surfaces; and (b) a rail connector incorporated into opposite ends of a meeting rail, the rail connector having top and bottom walls with respective upper and lower surfaces, each connector having a hole therethrough to receive the respective top and bottom tabs of the anchor;

wherein:

in a use configuration, the top tab is accessible through the top wall of the rail connector and the bottom tab is accessible through the bottom wall of the rail connector;

when the top tab of the anchor is pressed downward and the bottom tab of the anchor is pressed upward, the anchor deforms such that the top wall of the connector slides over the upper rail support of the anchor, and the bottom wall of the connector slides under lower rail support of the anchor, allowing the top and bottom tabs to be released and move into the respective holes of the top and bottom walls of the connector, automatically locking the connector in place on the anchor; and when the connector is locked in place on the anchor, the upper surface of the upper rail support contacts the lower surface of the connector top wall and the lower surface of the lower rail support contacts the upper surface of the connector bottom wall.

2. The connection system of claim 1 wherein the anchor is secured to the window frame by hooks.

3. The connection system of claim 1 wherein a screw for tightening and truing the connection system is installed through a hole in the rail connector and screwed in to the jamb.

4. The connection system of claim 3 wherein the screw is installed at an oblique angle with respect to the connector and the anchor.

5. The connection of claim 1 wherein when the top tab of the anchor is pressed downward and the bottom tab of the anchor is pressed upward, the anchor deforms such that the top wall of the connector slides over the upper rail support of the anchor and the bottom wall of the connector slides under lower rail support of the anchor, allowing the upper surface of upper rail support of the anchor to come into contact with and press against the bottom surface of the top wall of the connector and allowing the bottom surface of the lower rail support to come into contact with and press against the top surface of the bottom wall of the connector, thus securing the connector on the anchor.

6. A connection system for removably securing a window meeting rail to a window jamb comprising:

(a) an anchor secured to an inside wall of a widow jamb, the anchor having upper and lower rail supports adjacent to and projecting directly from a plate, the rail supports having respective vertically facing upper and lower surfaces and respective top and bottom tabs adjacent the respective upper and lower surfaces, the tabs extending outwardly beyond the respective upper and lower surfaces; and (b) a rail connector incorporated into opposite ends of a meeting rail, the rail connector having top and bottom walls, the top wall having a lower surface and the bottom wall having an upper surface;

wherein:

in a use configuration, the top tab is accessible through the top wall of the rail connector and the bottom tab is accessible though the bottom wall of the rail connector; and when the top tab of the anchor is pressed downward and the bottom tab of the anchor is pressed upward, the anchor deforms such that the top wall of the connector slides over the upper rail support of the anchor and the bottom wall of the connector slides under lower rail support of the anchor, allowing the upper surface of upper rail support of the anchor to come into contact with and press against the bottom surface of the top wall of the connector and allowing the bottom surface of the lower rail support to come into contact with and press against the top surface of the bottom wall of the connector to create an interference fit, thus securing the connector on the anchor.

7. The connection system of claim 6 wherein the anchor is secured to the window frame by hooks.

8. The connection system of claim 6 wherein a screw for tightening and truing the connection system is installed through a hole in the rail connector and screwed in to the jamb.

9. The connection system of claim 8 wherein the screw is installed at an oblique angle with respect to the connector and the anchor.

10. The connection system of claim 6 wherein when the top tab of the anchor is pressed downward and the bottom tab of the anchor is pressed upward, the anchor deforms such that the top wall of the connector slides over the upper rail support of the anchor, and the bottom wall of the connector slides under lower rail support of the anchor, allowing the top and bottom tabs to be released and move into the respective holes of the top and bottom walls of the connector, locking the connector in place on the anchor.

11. A connection system for removably securing a window meeting rail to a window frame comprising:

(a) an anchor secured to an inside wall of a window jamb, the anchor having upper and lower rail supports adjacent to and projecting directly from a plate, the rail supports having respective vertically facing upper and lower surfaces and respective top and bottom tabs adjacent the respective upper and lower surfaces, wherein the top and bottom tabs extend outwardly from the respective rail supports beyond the respective upper and lower surfaces;

(b) a rail connector incorporated into opposite ends of a meeting rail, the rail connector having top and bottom walls, each of which has a hole therethrough to receive the respective top and bottom tabs of the anchor;

wherein, when the rail connector receives the top and bottom tabs of the anchor, the upper surface of the upper rail support contacts the lower surface of the connector top wall and the lower surface of the lower rail support contacts the upper surface of the connector bottom wall; and wherein:

in a use configuration, the top tab is accessible through the top wall of the rail connector and the bottom tab is accessible through the bottom wall of the rail connector; and when the top tab of the anchor is pressed downward and the bottom tab of the anchor is pressed upward, the anchor deforms such that the tabs are withdrawn from the holes in the top and bottom walls of the connector, the top wall of the connector slides over the upper rail support of the anchor, and the bottom wall of the connector slides under lower rail support of the anchor, allowing the connector to be removed from the anchor and the meeting rail to be removed from the window jamb.

12. The connection system of claim 11 wherein the anchor is secured to the window frame by hooks.

13. The connection system of claim 11 wherein a screw for tightening and truing the connection system is installed through a hole in the rail connector and screwed in to the jamb.

14. The connection system of claim 13 wherein the screw is installed at an oblique angle with respect to the connector and the anchor.

15. A connection system for removably securing a window meeting rail to a window frame comprising:

(a) an anchor secured to an inside wall of window jamb, the anchor having upper and lower rail supports adjacent to and projecting directly from a plate, the rail supports having respective upper and lower surfaces;

(b) a rail connector incorporated into opposite ends of a meeting rail, the rail connector having top and bottom walls with respective apertures formed therein, the top wall having a bottom surface and the bottom wall having a upper surface;

wherein:

in a use configuration, a portion of the upper rail supports is accessible through the aperture in the top wall and a portion of the lower rail support is accessible through the aperture in the bottom wall;

when the portion of the upper rail support is pressed downward and the portion of the lower rail support is pressed upward, the anchor deforms such that the upper surface of upper rail support of the anchor is removed from contact with the bottom surface of the top wall of the connector and the lower surface of the lower rail support is removed from contact with the upper surface of the bottom wall of the connector, allowing the connector to be removed from the anchor and the meeting rail to be removed from the window jamb.

16. The connection system of claim 15 wherein the anchor is secured to the window frame by hooks.

17. The connection system of claim 15 wherein a screw for tightening and truing the connection system is installed through a hole in the rail connector and screwed in to the jamb.

* * * * *